US005707468A

United States Patent [19]

Arnold et al.

[11] Patent Number: 5,707,468

[45] Date of Patent: Jan. 13, 1998

[54] COMPACTION-FREE METHOD OF INCREASING THE INTEGRITY OF A NONWOVEN WEB

[75] Inventors: Billy Dean Arnold, Ramer, Tenn.; Samuel Edward Marmon, Alpharetta, Ga.; Richard Daniel Pike, Norcross, Ga.; Stephen Harding Primm, Cumming, Ga.; Lawrence James Romano, III, Marietta, Ga.; Philip Anthony Sasse, Alpharetta, Ga.

[73] Assignee: Kimberly-Clark Worldwide, Inc., Neenah, Wis.

[21] Appl. No.: 362,328

[22] Filed: Dec. 22, 1994

[51] Int. Cl.[6] ..... B27N 3/04

[52] U.S. Cl. ..... 156/62.6; 156/180; 156/181; 156/290; 156/296; 156/308.2; 156/309.9; 156/356; 428/198; 442/409; 442/411

[58] Field of Search ..... 156/180, 181, 156/290, 296, 356, 436, 933, 62.6, 308.2, 309.9; 428/224, 288, 296, 198; 442/409, 411

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,423,266 | 1/1969 | Davies et al. | 156/167 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 3,975,224 | 8/1976 | Rzek et al. | 156/167 |
| 4,011,124 | 3/1977 | Baxter | 156/358 |
| 4,041,203 | 8/1977 | Brock et al. | 428/157 |
| 4,083,913 | 4/1978 | Marshall | 264/121 |
| 4,340,563 | 7/1982 | Appel et al. | 264/518 |
| 4,578,141 | 3/1986 | Gidge et al. | 156/439 |
| 4,883,707 | 11/1989 | Newkirk | 428/219 |
| 5,108,820 | 4/1992 | Kaneko et al. | 428/198 |
| 5,108,827 | 4/1992 | Gessner | 428/284 |
| 5,169,706 | 12/1992 | Collier, IV et al. | 428/152 |
| 5,190,812 | 3/1993 | Joseph et al. | 428/297 |
| 5,229,191 | 7/1993 | Austin | 428/198 |
| 5,256,224 | 10/1993 | Gillyns et al. | 156/72 |
| 5,336,552 | 8/1994 | Strack et al. | 428/224 |
| 5,382,400 | 1/1995 | Pike et al. | 428/296 |
| 5,399,174 | 3/1995 | Yeo et al. | 604/365 |
| 5,593,768 | 1/1997 | Gessner . | |

FOREIGN PATENT DOCUMENTS

| | | | |
|---|---|---|---|
| 0 316 195 | 5/1989 | European Pat. Off. | D04H 1/56 |
| 0 400 581 | 12/1990 | European Pat. Off. . | |
| 0 586 924A1 | 3/1994 | European Pat. Off. | D04H 1/54 |
| 1 660 795 | 8/1972 | Germany . | |
| 05-239754 | 12/1993 | Japan . | |
| 06-158499 | 9/1994 | Japan . | |

OTHER PUBLICATIONS

Database WPI, Section Ch, Week 8706, Derwent Publications Ltd., London, GB; Class A35, AN 87-038706 XP002004314 & JP,A, 61 239 074 (Freudenberg), 24 Oct. 1986, See abstract.

*Polymer Blends and Composites* by John A. Manson and Leslie H. Sperling, Plenum Press, New York, Copyright 1976, ISBN 0-306-30831-2, pp. 273-277.

*Primary Examiner*—Marion E. McCamish
*Assistant Examiner*—Elizabeth M. Cole
*Attorney, Agent, or Firm*—James B. Robinson

[57] ABSTRACT

There is provided a process which comprises the step of subjecting a just produced spunbond web to a high flow rate, heated stream of air across substantially the width of the web to very lightly bond the fibers of the web together. Such bonding should be the minimum necessary in order to satisfy the needs of further processing yet not detrimentally affect the web. The fibers of the web may be monocomponent or biconstituent and the web should be substantially free of adhesives and not subjected to compaction rolls.

9 Claims, 3 Drawing Sheets

COMPACTION-FREE METHOD OF INCREASING THE INTEGRITY OF A NONWOVEN WEB

BACKGROUND OF THE INVENTION

This invention relates to the field of nonwoven fabrics or webs and their manufacture. More particularly, it relates to such nonwoven fabrics which are comprised of at least one layer of spunbond fibers or filaments. Such fibers are commonly comprised of a thermoplastic polymer such as polyolefins, e.g. polypropylene, polyamides, polyesters and polyethers.

Uses for such webs are in such applications as diapers, feminine hygiene products and barrier products such as medical gowns and surgical drapes.

In the process of production of a nonwoven spunbond web it is standard practice to increase the integrity of the web by some method for further processing. Increasing the web's integrity is necessary in order to maintain its form during post formation processing. Generally, compaction is used immediately after the formation of the web.

Compaction is accomplished by "compaction rolls" which squeeze the web in order to increase its self-adherence and thereby its integrity. Compaction rolls perform this function well but have a number of drawbacks. One such drawback is that compaction rolls do indeed compact the web, causing a decrease in bulk or loft in the fabric which may be undesirable for the use desired. A second and more serious drawback to compaction rolls is that the fabric will sometimes wrap around one or both of the rolls, causing a shutdown of the fabric production line for cleaning of the rolls, with the accompanying obvious loss in production during the down time. A third drawback to compaction rolls is that if a slight imperfection is produced in formation of the web, such as a drop of polymer being formed into the web, the compaction roll can force the drop into the foraminous belt, onto which most webs are formed, causing an imperfection in the belt and ruining it.

Accordingly, it is an object of this invention to provide a method of providing a nonwoven web with enough integrity for further processing without the use of compaction rolls or adhesives and which is suitable for use in continuous industrial production operation.

SUMMARY

The objects of this invention are achieved by a process which comprises the step of subjecting a just produced spunbond web to a high flow rate, heated stream of air across substantially the width of the web to very lightly bond the fibers of the web together. Such bonding should be the minimum necessary in order to satisfy the needs of further processing yet not detrimentally impacting the properties of the finished web. The fibers of the web may be monocomponent or biconstituent and the web should be substantially free of adhesives and not subjected to compaction rolls.

DEFINITIONS

Figure 1:
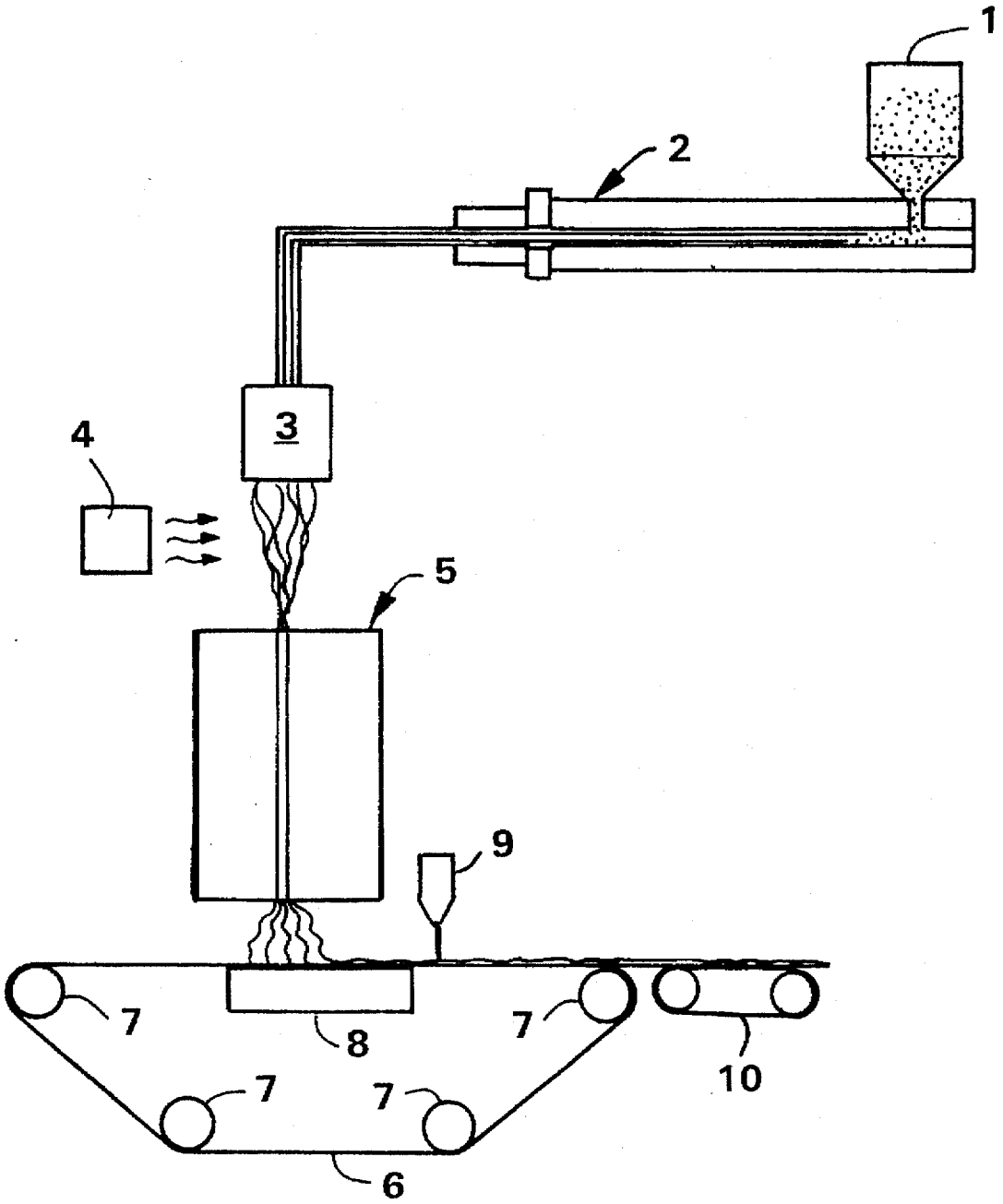
FIG. 1 is a schematic illustration of an apparatus which may be utilized to perform the method and to produce the nonwoven web of the present invention.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 0.5 microns to about 40 microns. Another frequently used expression of fiber diameter is denier, which is defined as grams per 9000 meters of a fiber. For example, the diameter of a polypropylene fiber given in microns may be converted to denier by squaring, and multiplying the result by 0.00629, thus, a 15 micron polypropylene fiber has a denier of about 1.42 ($15^2 \times 0.00629 = 1.415$).

As used herein the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by the process shown, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. Nos. 3,502,538 to Levy, U.S. Pat. No. 3,502,763 to Hartman, and U.S. Pat. No. 3,542,615 to Dobo et al. Spunbond fibers are generally continuous and have diameters larger than 7 microns, more particularly, between about 10 and 30 microns. Spunbond fibers are generally not tacky when they are deposited onto the collecting surface.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Meltblown fibers are generally tacky when they are deposited on the collecting surface. Such a process is disclosed, for example, in U.S. Pat. No. 3,849,241 to Butin. Meltblown fibers are microfibers which may be continuous or discontinuous and are generally smaller than 10 microns in diameter.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible molecular geometrical configurations of the material. These configurations include, but are not limited to isotactic, syndiotactic and random symmetries.

As used herein, the term "machine direction" or "MD" means the length of a fabric in the direction in which it is produced. The term "cross machine direction" or "CD" means the width of fabric, i.e. a direction generally perpendicular to the MD.

As used herein the term "monocomponent" fibers refers to fibers formed from one polymer only. This is not meant to exclude fibers formed from one polymer to which small amounts of additives have been added for coloration, antistatic properties, lubrication, hydrophilicity, etc. These additives, e.g. titanium dioxide for coloration, are generally present in an amount less than 5 weight percent and more typically about 2 weight percent.

As used herein the term "bicomponent fibers" refers to fibers which have been formed from at least two polymers extruded from separate extruders but spun together to form one fiber. The polymers are arranged in substantially constantly positioned distinct zones across the cross-section of the bicomponent fibers which extend continuously along the length of the bicomponent fibers. The configuration of such a bicomponent fiber may be, for example, a sheath/core arrangement wherein one polymer is surrounded by another or may be a side by side arrangement or an "islands-in-the-sea" arrangement. Bicomponent fibers are taught in U.S. Pat. No. 5,108,820 to Kaneko et al., U.S. Pat. No. 5,336,552 to Strack et al., and European Patent 0586924. If two polymers are used they may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, through air bonding or "TAB" means a process of bonding a nonwoven bicomponent fiber web which is wound at least partially around a perforated roller which is enclosed in a hood. Air which is sufficiently hot to melt one of the polymers of which the fibers of the web are made is forced from the hood, through the web and into the perforated roller. The air velocity is between 100 and 500 feet per minute and the dwell time may be as long as 6 seconds. The melting and resolidification of the polymer provides the bonding. Through air bonding has restricted variability and is generally regarded a second step bonding process. Since TAB requires the melting of at least one component to accomplish bonding, it is restricted to bicomponent fiber webs.

As used herein, the term "medical product" means surgical gowns and drapes, face masks, head coverings, shoe coverings wound dressings, bandages, sterilization wraps, wipers and the like.

As used herein, the term "personal care product" means diapers, training pants, absorbent underpants, adult incontinence products, and feminine hygiene products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

As used herein, the term "outdoor fabric" means a fabric which is primarily, though not exclusively, used outdoors. Outdoor fabric includes fabric used in protective covers, camper/trailer fabric, tarpaulins, awnings, canopies, tents, agricultural fabrics and outdoor apparel such as head coverings, industrial work wear and coverails, pants, shirts, jackets, gloves, socks, shoe coverings, and the like.

TEST METHODS

Cup Crush: The drapeability of a nonwoven fabric may be measured according to the "cup crush" test. The cup crush test evaluates fabric stiffness by measuring the peak load required for a 4.5 cm diameter hemispherically shaped foot to deform a 23 cm by 23 cm piece of fabric into an approximately 6.5 cm diameter by 6.5 cm tall inverted cylinder while the cup shaped fabric is surrounded by an approximately 6.5 cm diameter cylinder to maintain a uniform deformation of the cup shaped fabric. The foot and the cylinder are aligned to avoid contact between the cup walls and the foot which could affect the peak load. The peak load is measured while the foot is descending at a rate of about 0.25 inches per second (38 cm per minute). A lower cup crush value indicates a softer web. A suitable device for measuring cup crush is a model FTD-G-500 load cell (500 gram range) available from the Schaevitz Company, Pennsauken, N.J. Cup crush is measured in grams.

Tensile: The tensile strength of a fabric may be measured according to the ASTM test D-1682-64. This test measures the strength in pounds and elongation in percent of a fabric.

DETAILED DESCRIPTION OF THE INVENTION

Spunbonded fibers are small diameter fibers which are formed by extruding molten thermoplastic material as filaments from a plurality of fine, usually circular capillaries of a spinnerette with the diameter of the extruded filaments then being rapidly reduced. Spunbond fibers are generally continuous and have diameters larger than 7 microns, more particularly, between about 10 and 30 microns. The fibers are usually deposited on a moving foraminous belt or forming wire where they form a web.

Spunbond fabrics are generally lightly bonded in some manner immediately as they are produced in order to give them sufficient structural integrity to withstand the rigors of further processing into a finished product. This light, first step bonding may be accomplished through the use of an adhesive applied to the fibers as a liquid or powder which may be heat activated, or more commonly, by compaction rolls.

The fabric then generally moves on to a more substantial second step bonding procedure where it may be bonded with other nonwoven layers which may be spunbond, meltblown or bonded carded webs, films, woven fabrics, foams, etc. The second step bonding can be accomplished in a number of ways such as hydroentanglement, needling, ultrasonic bonding, through air bonding, adhesive bonding and thermal point bonding or calendering.

Compaction rolls are widely used for the light, first step bonding and have a number of drawbacks which were outlined above. For example, shutdowns caused by the wrapping of the nonwoven web are quite costly. These "compaction wraps" require dismantling and cleaning of the compaction rolls which take a substantial amount of time and effort. This is expensive not only from the point of view of lost or discarded material but from the loss of production, assuming one is operating at full capacity. Compaction rolls also can force a drop of polymer from a formation imperfection into the foraminous belt or forming wire onto which most spunbond webs are formed. This "grinding in" of the polymer drop can ruin a belt for further use, requiring its replacement. Since forming wires are quite long and of specialized materials, replacement costs can run as high as $50,000, as of this writing, in addition to the lost production while changing the belt.

The novel method of providing integrity to a nonwoven web which is the subject of this invention avoids the use of compaction rolls and adhesives. This invention functions through the use of a "hot air knife" or HAK. A hot air knife is a device which focuses a stream of heated air at a very high flow rate, generally from about 1000 to about 10000 feet per minute (fpm) (305 to 3050 meters per minute), directed at the nonwoven web immediately after its formation.

The HAK air is heated to a temperature insufficient to melt the polymer in the fiber but sufficient to soften it slightly. This temperature is generally between about 200° and 550° F. (93° and 290° C.) for the thermoplastic polymers commonly used in spunbonding.

The HAK's focused stream of air is arranged and directed by at least one slot of about ⅛ to 1 inches (3 to 25 mm) in width, particularly about ⅜ inch (9.4 mm), serving as the exit for the heated air towards the web, with the slot running in a substantially cross machine direction over substantially the entire width of the web. In other embodiments, there may be a plurality of slots arranged next to each other or separated by a slight gap. The at least one slot is preferably, though not essentially, continuous, and may be comprised of, for example, closely spaced holes.

Figure 2:
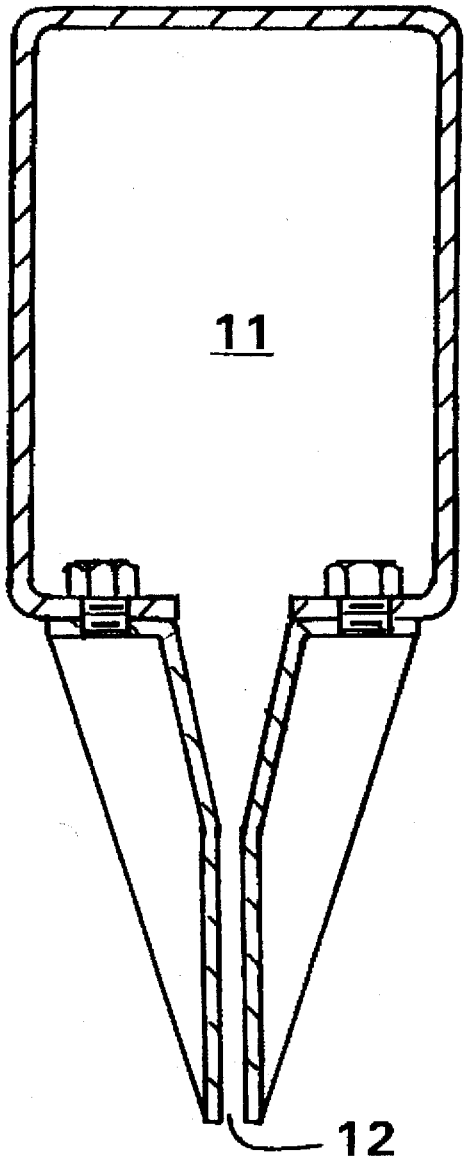
FIG. 2 is a cross-sectional view of a device which may be used in the practice of this invention.

The HAK has a plenum to distribute and contain the heated air prior to its exiting the slot. The plenum pressure of the HAK is preferably between about 1.0 and 12.0 inches of water (2 to 22 mmHg), and the HAK is positioned between about 0.25 and 10 inches and more preferably 0.75 to 3.0 inches (19 to 76 mm) above the forming wire. In a particular embodiment, the HAK's plenum size, as shown in FIG. 2, is at least twice the cross sectional area for CD flow relative to the total exit slot area.

Since the foraminous wire onto which the polymer is formed generally moves at a high rate of speed, the time of exposure of any particular part of the web to the air discharged from the hot air knife is less a tenth of a second and generally about a hundredth of a second in contrast with the through air bonding process which has a much larger dwell time. The HAK process has a great range of variability and controllability of at least the air temperature, air velocity and distance from the HAK plenum to the web.

As mentioned above, the spunbond process uses thermoplastic polymers which may be any known to those skilled in the art. Such polymers include polyolefins, polyesters, polyetherester, polyurethanes and polyamides, and mixtures thereof, more particularly polyolefins such as polyethylene, polypropylene, polybutene, ethylene copolymers, propylene copolymers and butene copolymers. Polypropylenes that have been found useful include, for example, polypropylene available from the Himont Corporation of Wilmington, Del., under the trade designation PF-304, polypropylene available from the Exxon Chemical Company of Baytown, Tex. under the trade designation Exxon 3445 and polypropylene available from the Shell Chemical Company of Houston, Tex. under the trade designation DX 5A09.

The use of a heated air stream with bicomponent fibers is mentioned in U.S. patent application Ser. No. 08/055,449, filed Apr. 29, 1993, continued as 08/435,239, for which the issue has been paid, and assigned to the same assignee as this application. In the cited application, the process was used to activate an adhesive binder or melt a low melting point polymer component of the bicomponent fiber. Since the use of a heated air stream served to melt the web in the above application, it was believed to require the use of at least two different melting fiber components arranged as a bicomponent with one component having a low melting point, or an adhesive, in order for the process to function.

Though the instant invention may use air temperatures above the melting point the polymer, the surface of the polymer does not reach its melting point by controlling the air flow rate and maintaining the web's exposure within the specified time range.

The inventors have surprisingly discovered that a properly controlled HAK, operating under the conditions presented herein, can serve to lightly bond a monocomponent or biconstituent fiber spunbond web without detrimentally affecting web properties and may even improve the web properties, thereby obviating the need for compaction rolls.

Referring to the drawings, particularly to FIG. 1, there is schematically illustrated at 20 an exemplary process for providing integrity to a spunbond web without the use of adhesives or compaction rolls.

Polymer is added to the hopper 1 from which it is fed into the extruder 2. The extruder 2 heats the polymer and melts it and forces it into the spinnerette 3. The spinnerette 3 has openings arranged in one or more rows. The spinnerette 3 openings form a downwardly extending curtain of filaments when the polymer is extruded. Air from a quench blower 4 quenches the filaments extending from the spinnerette 3. A fiber draw unit 5 is positioned below the spinnerette 3 and receives the quenched filaments.

Illustrative fiber draw units are shown in U.S. Pat. Nos. 3,802,817, 3,692,618 and 3,423,266. The fiber draw unit draws the filaments or fibers by aspirating air entering from the sides of the passage and flowing downwardly through the passage.

An endless, generally foraminous forming surface 6 receives the continuous spunbond fibers from the fiber draw unit 5. The forming surface 6 is a belt which travels around guide rollers 7. A vacuum 8 positioned below the forming surface 6 draws the fibers against the forming surface 6. Immediately after formation, hot air is directed through the fibers from a hot air knife (HAK) 9. The HAK 9 gives the web sufficient integrity to be passed off of the forming surface 6 and onto belt 10 for further processing.

FIG. 2 shows the cross-sectional view of an exemplary hot air knife. The area of the plenum 11 is at least twice the cross sectional area for CD flow relative to the total slot air exit area 12.

Figure 3:
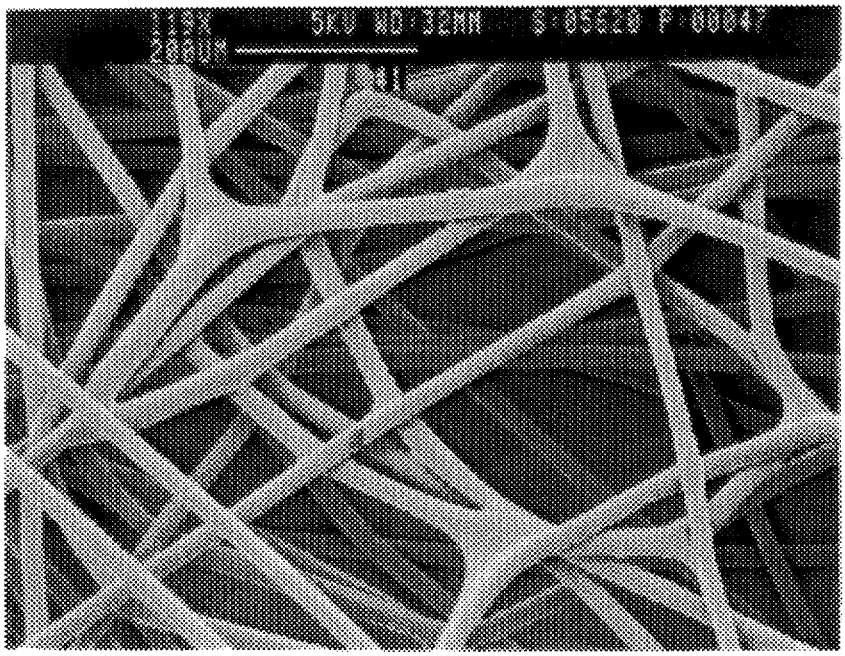
FIGS. 3 and 4 are scanning electron micrographs of two webs made in accordance with the invention.
Figure 4:
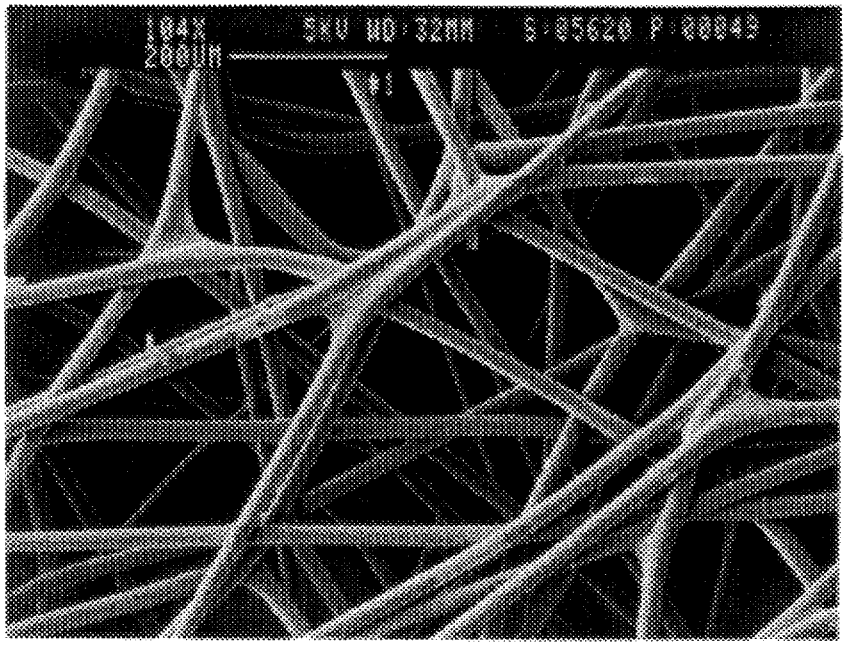

FIGS. 3 and 4 show scanning electron micrograph (SEM) pictures of webs which have been treated by the HAK. The web of FIG. 4 has been treated at slightly more severe conditions than that of FIG. 3. Note that there is little bonding between the filaments in FIG. 3 and a bit more in FIG. 4. FIG. 3 is at a magnification of 119× and FIG. 4 is at a magnification of 104×. Webs subjected to compaction rolls alone do not have these characteristic bonds.

The fabric used in the process of this invention may be a single layer embodiment or a multilayer laminate of spunbond and other fibers. Such fabrics usually have a basis weight of from about 0.15 to 12 osy (5 to about 407 gsm). Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al. or as a spunbond/spunbond laminate. Note that there may be more than one meltblown layer present in the laminate.

An SMS laminate may be made by sequentially depositing onto a moving conveyor belt or forming wire first a spunbond fabric layer, then at least one meltblown fabric layer and last another spunbond layer, treating the web with the HAK after the deposition of each spunbond layer. Treating meltblown layers with the HAK is not thought necessary since meltblown fibers are usually tacky when they are deposited and so therefore naturally adhere to the collection surface, which in the case of an SMS laminate is a spunbond layer. Alternatively, the fabric layers may be made individually, collected in rolls, and combined in a separate bonding step, with each spunbond layer having been subjected to the HAK as it was produced.

The more substantial secondary bonding step is generally accomplished by the methods previously mentioned. One such method is calendering and various patterns for calender rolls have been developed. One example is the expanded Hansen Pennings pattern with about a 15% bond area with about 100 bonds/square inch as taught in U.S. Pat. No. 3,855,046 to Hansen and Pennings. Another common pattern is a diamond pattern with repeating and slightly offset diamonds.

The fabric of this invention may also be laminated with films, glass fibers, staple fibers, paper, and other commonly used materials known to those skilled in the art.

CONTROL 1

Nonwoven spunbond webs were made generally according to FIG. 1 in which the layer was deposited onto a moving forming wire. Five samples were made with an average 1.24 osy (42 gsm) basis weight. The polymer used to produce the layer was Exxon 3445 polypropylene to which was added 2 weight percent of titanium dioxide ($TiO_2$) to provide a white color to the web. The $TiO_2$ used was designated SCC4837 and is available from the Standridge Color Corporation of Social Circle, Ga. The web was processed through compaction rolls after formation and a hot air knife was not used.

CONTROL 2

Nonwoven spunbond webs were made generally according to FIG. 1 in which the layer was deposited onto a moving forming wire, except that the web was processed through compaction rolls after formation and a hot air knife was not used. Five samples were made with an average 0.6 osy (20 gsm) basis weight. The polymer and additive were the same as in Control 1.

CONTROL 3

Nonwoven spunbond webs were made generally according to FIG. 1 in which the layer was deposited onto a moving forming wire, except that the web was processed through compaction rolls after formation and a hot air knife was not used. Five samples were made with an average 0.5 osy (17 gsm) basis weight. The polymer and additive were the same as in Control 1.

EXAMPLE 1

Nonwoven spunbond webs were made generally according to FIG. 1 in which the layer was deposited onto a moving forming wire. Five samples were made with an average 1.25 osy (42 gsm) basis weight. The polymer used to produce the layer was Exxon 3445 polypropylene to which was added 2 weight percent of titanium dioxide ($TiO_2$) to provide a white color to the web. The $TiO_2$ used was designated SCC4837 and is available from the Standridge Color Corporation of Social Circle, Ga. The web was not processed through compaction rolls after formation but instead was treated by a hot air knife. The HAK was positioned 1 inch above the web and the HAK slot was one quarter of an inch wide. The HAK had a plenum pressure of 7 inches of water (13 mmHg) and a temperature of 320° F. (160° C.). The exposure time of the web to the air of the HAK was less than a tenth of a second.

EXAMPLE 2

Nonwoven spunbond webs were made generally according to FIG. 1 in which the layer was deposited onto a moving forming wire. Five samples were made with an average 0.6 osy (20 gsm) basis weight. The polymer and additive were the same as in Example 1. The web was not processed through compaction rolls after formation but instead was treated by a hot air knife. The HAK was positioned 1 inch above the web and the HAK slot was one quarter of an inch wide. The HAK had a plenum pressure of 7 inches of water (13 mmHg) and a temperature of 320° F. (160° C.). The exposure time of the web to the air of the HAK was less than a tenth of a second.

EXAMPLE 3

Nonwoven spunbond webs were made generally according to FIG. 1 in which the layer was deposited onto a moving forming wire. Five samples were made with an average 0.5 osy (17 gsm) basis weight. The polymer and additive were the same as in Control 1. The web was not processed through compaction rolls after formation but instead was treated by a hot air knife. The PLAK was positioned 1 inch above the web and the HAK slot was one quarter of an inch wide. The HAK had a plenum pressure of 7 inches of water (13 mmHg) and a temperature of 330° F. (166° C.). The exposure time of the web to the air of the HAK was less than a tenth of a second.

The average results of the testing of the five webs of each Control and Example are shown in Table 1. Line speed is given in feet per minute, plenum pressure in inches of water and temperature in °F.

TABLE 1

| | Controls | | | Examples | | |
|---|---|---|---|---|---|---|
| | 1 | 2 | 3 | 1 | 2 | 3 |
| OSY | 1.24 | 0.62 | 0.51 | 1.25 | 0.62 | 0.5 |
| MD Tensile | 24.6 | 11.4 | 8.6 | 22.9 | 11.2 | 8.7 |
| CD Tensile | 20.6 | 8.2 | 7.3 | 18.8 | 9.2 | 6.2 |
| Cup Crush | 162.6 | 39.8 | 27.4 | 172.6 | 43.8 | 29.4 |
| Crush Energy | 3062 | 776 | 423 | 3416 | 733 | 517 |
| Line Speed | 184 | 374 | 464 | 184 | 374 | 464 |
| Plenum Pres. | NA | NA | NA | 7 | 7 | 7 |
| Temperature | NA | NA | NA | 320 | 320 | 330 |

It can be seen from the preceding examples that a hot air knife can accomplish web integrity results comparable if not superior to those of compaction rolls without the tremendous and costly problems which have been experienced with those devices and without negatively impacting key web properties such as strength or drape.

We claim:

1. A method of providing integrity to a spunbond web comprising the steps of:

forming a spunbond web from a fiber selected from the group consisting of monocomponent and biconstituent fibers, passing the web through a hot air knife having at least one slot to lightly bond the fibers of the web in order to provide sufficient integrity to the web for further processing, wherein said hot air knife operates at a temperature of between about 200° and 550° F. (93° and 290° C.), with a focused stream of air and an air flow of between about 1000 and 10000 feet per minute (305 to 3050 meters per minute), and wherein said web is substantially free of adhesives before said passing step, said web is not subjected to compaction rollers pdor to said hot air knife and said web is subjected to said hot air knife for less than one tenth of a second.

2. The method of claim 1 wherein said hot air knife has a plenum having a cross sectional area for CD flow, and a slot having a total exit area, wherein said plenum cross sectional area is at least twice the slot total exit area.

3. The method of claim 1 wherein said web is comprised of microfibers of a polymer selected from the group consisting of polyolefins, polyamides, polyetheresters, polyesters and polyurethanes.

4. The method of claim 3 wherein said polymer is a polyolefin.

5. The method of claim 4 wherein said polyolefin is polypropylene.

6. The method of claim 4 wherein said polyolefin is polyethylene.

7. The method of claim 1 further comprising the step of depositing onto said web at least one meltblown layer after passing said web through said hot air knife.

8. The method of claim 7 further comprising the step of depositing onto said web and said at least one meltblown layer, a second spunbond layer adjacent said meltblown layers to form a laminate and then again passing said laminate through said hot air knife.

9. The method of claim 8 further comprising the step of thermal point bonding said laminate.

* * * * *